US007927119B2

(12) United States Patent
Zahnen et al.

(10) Patent No.: US 7,927,119 B2
(45) Date of Patent: Apr. 19, 2011

(54) ELECTRICAL CONNECTOR INCLUDING CABLE END SEALS WITH TEAR STOP MEMBER AND RELATED METHODS

(75) Inventors: James L. Zahnen, Ormond Beach, FL (US); Matthew D. Cawood, De Leon Springs, FL (US); Eric Belknap, Daytona Beach, FL (US)

(73) Assignee: Thomas & Betts International, Inc., Wilmington, DE (US)

( * ) Notice: Subject to any disclaimer, the term of this patent is extended or adjusted under 35 U.S.C. 154(b) by 135 days.

(21) Appl. No.: 12/356,638

(22) Filed: Jan. 21, 2009

(65) Prior Publication Data

US 2009/0181577 A1 Jul. 16, 2009

Related U.S. Application Data

(63) Continuation-in-part of application No. 11/757,619, filed on Jun. 4, 2007, now Pat. No. 7,611,379.

(60) Provisional application No. 60/803,932, filed on Jun. 5, 2006, provisional application No. 60/890,368, filed on Feb. 16, 2007.

(51) Int. Cl.
*H01R 13/52* (2006.01)

(52) U.S. Cl. ..... 439/276

(58) Field of Classification Search ..... 439/276, 439/936, 475, 590, 523, 521, 588, 589; 174/71 B, 174/99 B, 74 R, 75 D
See application file for complete search history.

(56) References Cited

U.S. PATENT DOCUMENTS

| | | | | |
|---|---|---|---|---|
| 2,932,685 | A | 4/1960 | Raila et al. | 174/84 C |
| 4,839,937 | A | 6/1989 | Oikawa et al. | 174/153 G |
| 5,533,912 | A | 7/1996 | Fillinger et al. | 439/521 |
| 5,711,066 | A | 1/1998 | Castaldo | 29/855 |
| 6,263,567 | B1 | 7/2001 | McGrane | 29/884 |
| 6,323,433 | B1 | 11/2001 | Mahaney et al. | 174/152 G |
| 6,345,438 | B1 | 2/2002 | Zahnen et al. | 29/876 |
| 6,347,966 | B1 | 2/2002 | Hielscher | 439/798 |
| 6,688,921 | B2 * | 2/2004 | Borgstrom et al. | 439/798 |
| 6,854,996 | B2 | 2/2005 | Yaworski et al. | 439/276 |
| 7,090,532 | B1 * | 8/2006 | Kaine | 439/523 |
| 7,144,279 | B2 | 12/2006 | Zahnen et al. | 439/709 |
| 7,160,146 | B2 | 1/2007 | Cawood et al. | 439/521 |
| 2003/0087552 | A1 | 5/2003 | Borgstrom et al. | 439/590 |
| 2004/0161968 | A1 | 8/2004 | Cawood et al. | 439/521 |

FOREIGN PATENT DOCUMENTS

| | | |
|---|---|---|
| EP | 1089411 | 4/2001 |

* cited by examiner

*Primary Examiner* — Alexander Gilman

(74) *Attorney, Agent, or Firm* — Allen, Dyer, Doppelt, Milbrath & Gilchrist, P.A.

(57) ABSTRACT

An electrical connector for a plurality of electrical cables includes an electrically conductive body having a plurality of spaced apart cable-receiving passageways for receiving respective electrical cable ends therein, and having at least one respective fastener-receiving passageway intersecting each of the cable-receiving passageways. An insulating cover is on the electrically conductive body and has a respective cable inlet aligned with each of the cable-receiving passageways. A respective cable end seal is associated with each of the cable inlets and includes a first tear stop member having a planar portion defining a central opening, and at least one coaxial and coplanar rib extending from the planar portion and spaced from the central opening. A second tear stop member is coupled to the first annular tear stop member at the central opening and includes a series of stepped tear stop portions having progressively decreasing diameters.

33 Claims, 16 Drawing Sheets

ELECTRICAL CONNECTOR INCLUDING CABLE END SEALS WITH TEAR STOP MEMBER AND RELATED METHODS

RELATED APPLICATIONS

The present application is a continuation-in-part of U.S. patent application Ser. No. 11/757,619 filed Jun. 4, 2007, now U.S. Pat. No. 7,611,379 which is based upon prior filed copending provisional application Ser. No. 60/803,932 filed Jun. 5, 2006 and provisional application Ser. No. 60/890,368 filed Feb. 16, 2007, the entire subject matter of which are incorporated herein by reference in their entireties.

FIELD OF THE INVENTION

The present invention relates to the field of electrical components, and, more particularly, to an electrical connector for connecting together a plurality of cable ends, and associated methods.

BACKGROUND OF THE INVENTION

Underground and submersible junction bus connectors are widely used in electrical power distribution systems. One type of such connector is offered under the designation SWEETHEART® by Thomas & Betts International, Inc. of Memphis, Tenn., the assignee of the present invention. The SWEETHEART® connector is a cast or welded aluminum connector including a bus, or bar, portion and a series of tubular posts extending outwardly from the bus portion. The posts have an open upper end to receive one or more electrical conductors. A threaded bore is provided in the sidewall of the post, and which receives a fastener to secure the electrical conductor within the upper end of the post. An insulating coating is provided on the lower portion of the posts and bus of the connector. In addition, EPDM insulating sleeves may be used to provide waterproof seals for the posts. U.S. Pat. Nos. 6,347,966; 6,345,438 and 6,263,567 disclose various embodiments of such bus and post connectors.

Thomas & Betts also manufacturers a RAB series of "Flood Seal"® Rubberized Aluminum Bar connectors suitable for direct burial, handhole or pedestal applications. The RAB connector includes a generally rectangular aluminum body having a plurality of spaced apart cable-receiving passageways therein. As the name states, the RAB connector includes a rubber insulating cover over the connector body. The insulating cover includes integrally molded inlets for both the cable-receiving openings and fastener-receiving openings. An insulating boot, such as a cable size adaptor or Rocket may be provided for the cable-receiving inlet, and a sealing cap may be received over the screw in the fastener-receiving inlet.

U.S. Pat. No. 6,688,921 to Borgstrom et al. discloses a connector similar to the Thomas & Betts RAB series connector. In place of EPDM, the patent uses a thermoplastic elastomer (TPE) that combines the properties of thermoplastic with the performance characteristics of a thermoset rubber. The use of TPE enables the molding to further form sealing plugs attached to the cover with respective tethers. A cable size adaptor is frangibly connected to each sealing plug via an integrally molded web.

Michaud Electrical Equipment of France offered an insulation displacing connector (IDC) including a generally rectangular connector body, and transverse cable-receiving and fastener-receiving passageways. More particularly, the connector body included a backwall having a pattern of sharp ridges thereon to pierce the insulation on the cable end as the end of the fastener engages and presses against the cable end from the opposite side. To be sure the cable end is fully pressed onto the sharp ridges, a plastic viewing window is provided opposite the inlet of the cable-receiving passageway. Accordingly, an installer can view the cable end to be sure the insulation has been pierced. The window is adjacent the rubber cover. Unfortunately, the Michaud IDC device is likely to leak at the window since the seal is only a mechanical seal. In addition, insulation displacement technology may not be suitable for larger cable sizes with thicker insulation coverings.

A significant advance in the area of connectors is disclosed in U.S. Pat. No. 7,144,279, assigned to Thomas & Betts International, Inc., the assignee of the present invention. The connector includes an electrically conductive body, a thermoplastic elastomer (TPE) insulating cover, and windows aligned with cable end viewing openings in the conductive body. The electrically conductive body has spaced apart cable-receiving passageways for receiving respective electrical cable ends therein, and with each cable-receiving passageway having a cable inlet opening and a cable end viewing opening opposite the cable inlet opening. The electrically conductive body also has a respective fastener-receiving passageway intersecting each of the cable-receiving passageways. The windows provide a cover and permit visual confirmation of proper placement of the electrical cable end within a corresponding one of the cable-receiving passageways. The electrical connector also includes a respective removable fastener inlet closure cap for each tubular fastener inlet, and a respective flexible tether having a proximal end removably connected adjacent a corresponding tubular fastener inlet and a distal end integrally molded with a corresponding removable fastener inlet closure cap. A respective insulating boot may be received in each of the tubular cable inlets. Each insulating boot may include a tubular sidewall having a progressively increasing diameter to an open outer end thereof, a removable boot closure cap for removable positioning in the open outer end of the tubular sidewall, and an integrally molded tether connecting the removable boot closure cap to the tubular sidewall.

U.S. Pat. No. 7,160,146 to Cawood et al., and assigned to the assignee of the present application, discloses an insulating boot associated with the conductor receiving passageway of an electrical connector. The insulating boot may include an insulating tube, and at least one rupturable seal closing the insulating tube and rupturing upon initial insertion of the cable end therethrough. The rupturable seal may also be compliant to accommodate different sized cable ends and form a seal with adjacent portions of the cable end. A pair of seals may be provided with an optional sealant material therebetween.

A number of attempts have been made to provide environmental cable end seals for the connectors of the type described above, in particular, to accommodate various size wires and cables that may be advantageously used with such connectors. Unfortunately, such seals have not always provided proper sealing or accommodated sufficiently differently sized wires and cables.

SUMMARY OF THE INVENTION

In view of the foregoing background, it is therefore an object of the present invention to provide an electrical connector with cable end seals that effectively seal and yet still accommodate a wide range of wire and cable sizes, and related methods.

This and other objects, features, and advantages in accordance with the present invention are provided by an electrical connector for a plurality of electrical cables. The electrical connector may comprise an electrically conductive body having a plurality of spaced apart cable-receiving passageways for receiving respective electrical cable ends therein, and may have at least one respective fastener-receiving passageway intersecting each of the cable-receiving passageways. There may be an insulating cover on the electrically conductive body that has a respective cable inlet aligned with each of the cable-receiving passageways.

A respective cable end seal may be associated with each of the cable inlets and may comprise a resilient, tearable body of material. The cable end seal may include a first tear stop member comprising a planar portion defining a central opening. At least one coaxial and coplanar rib may extend from the planar portion and may be spaced from the central opening. A second tear stop member may be coupled to the first annular tear stop member at the central opening and may comprise a series of stepped tear stop portions having progressively decreasing diameters. This provides a cable end seal that effectively seals the electrical connector yet accommodates a wide range of wire and cable sizes.

The cable end seal may further comprise a tubular intermediate portion coupled to the first tear stop member at a periphery thereof. In addition, a tubular base portion may be coupled to the tubular intermediate portion. Further, an outer tubular portion may be coupled to the tubular base portion and may surround in spaced relation the tubular intermediate portion to receive a corresponding cable inlet therebetween.

The second tear stop member may have a closed distal end. Alternatively, the second tear stop member may have an open distal end.

A wall thickness of the first tear stop member may be greater than a wall thickness of the second tear stop member. Also, the first and second tear stop members may be integrally molded as a monolithic unit. The resilient, tearable body material may comprise at least one of a silicone material, a thermoplastic elastomeric material, and a rubber material.

Another aspect is directed to a method for making an electrical connector for a plurality of electrical cables. The method may comprise forming an electrically conductive body having a plurality of spaced apart cable-receiving passageways for receiving respective electrical cable ends therein, and having at least one respective fastener-receiving passageway intersecting each of the cable-receiving passageways.

An insulating cover may be positioned on the electrically conductive body and may have a respective cable inlet aligned with each of the cable-receiving passageways. A respective cable end seal may be formed for being associated with each of the cable inlets. The cable end seal may comprise a first tear stop member comprising a planar portion defining a central opening, and at least one coaxial and coplanar rib extending from the planar portion and spaced from the central opening. A second tear stop member may be coupled to the first annular tear stop member at the central opening and may comprise a series of stepped tear stop portions having progressively decreasing diameters.

DETAILED DESCRIPTION OF THE PREFERRED EMBODIMENTS

Figure 1:
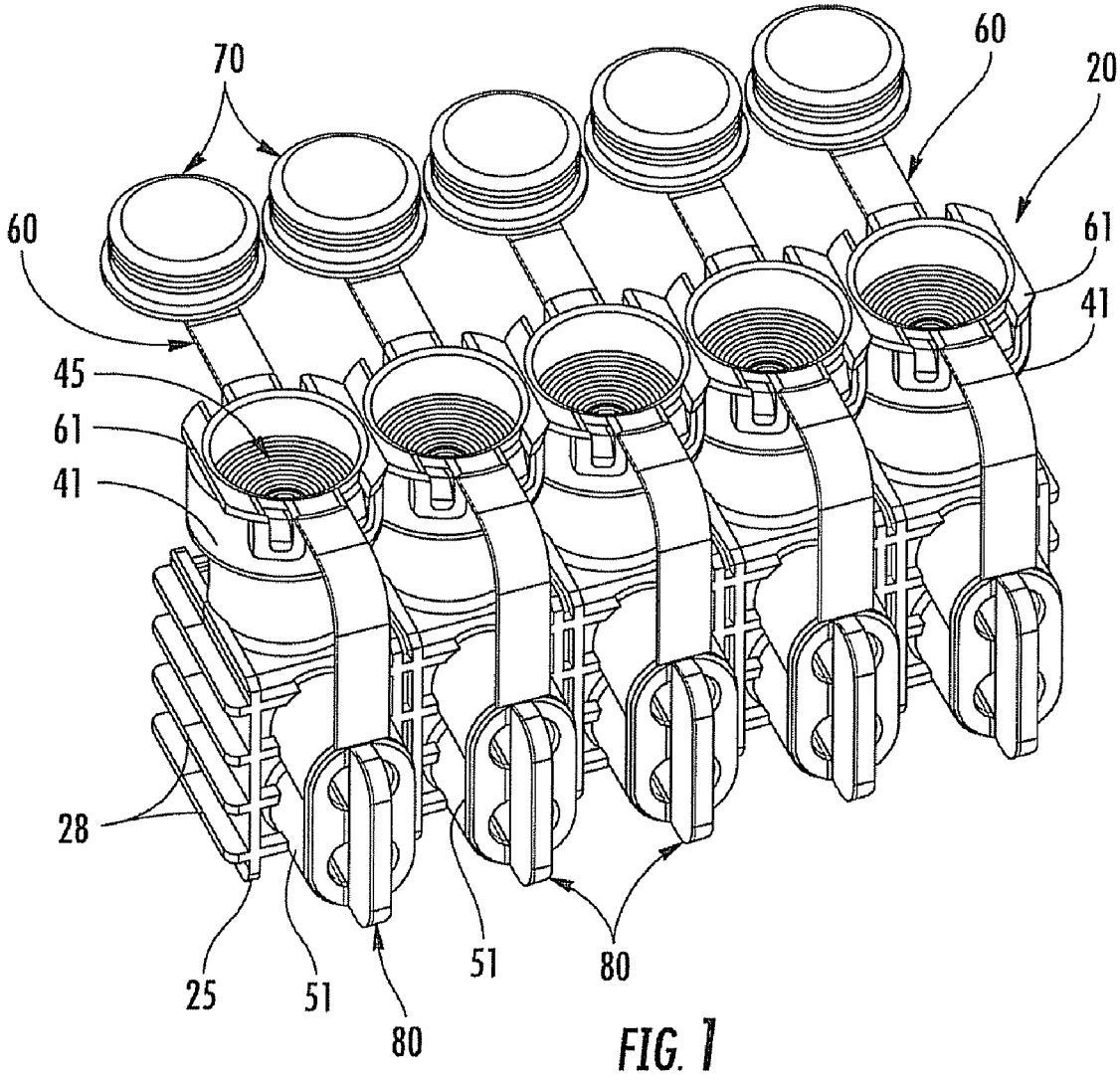
FIG. 1 is a front perspective view of an embodiment of an electrical connector in accordance with the present invention.
Figure 2:
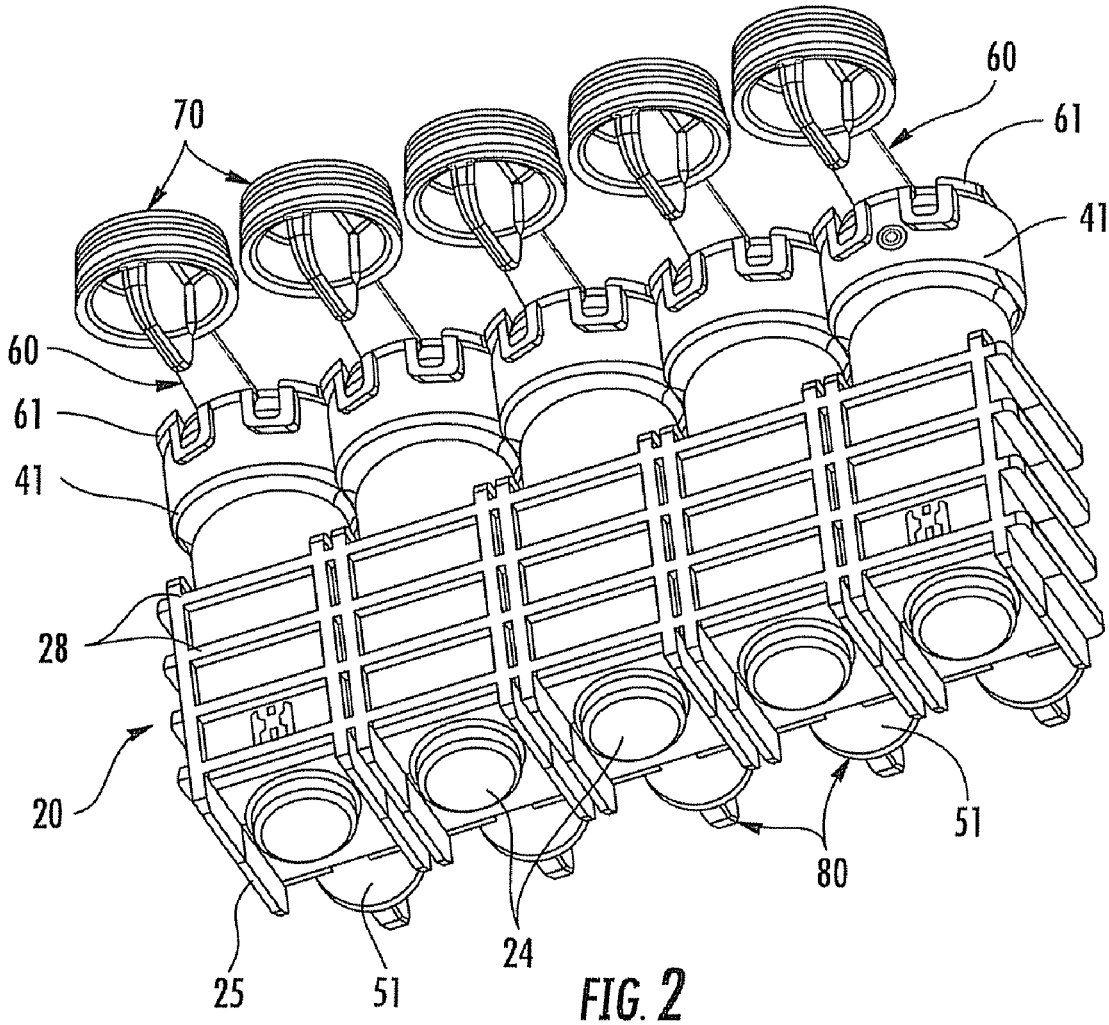
FIG. 2 is a rear perspective view of the electrical connector shown in FIG. 1.

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternative embodiments.

Referring now initially to FIGS. 1-6, an electrical connector 20 in accordance with the present invention is described. The electrical connector 20 is for a plurality of electrical cables and illustratively comprises an electrically conductive body 21 (FIG. 6), an insulating cover 25, and a plurality of windows 24 (FIG. 2) aligned with cable end viewing openings 23 (FIG. 6) in the conductive body. The electrically conductive body 21 illustratively has a generally rectangular shape, and may be formed of aluminum, or other conductive material, for example.

Figure 6:
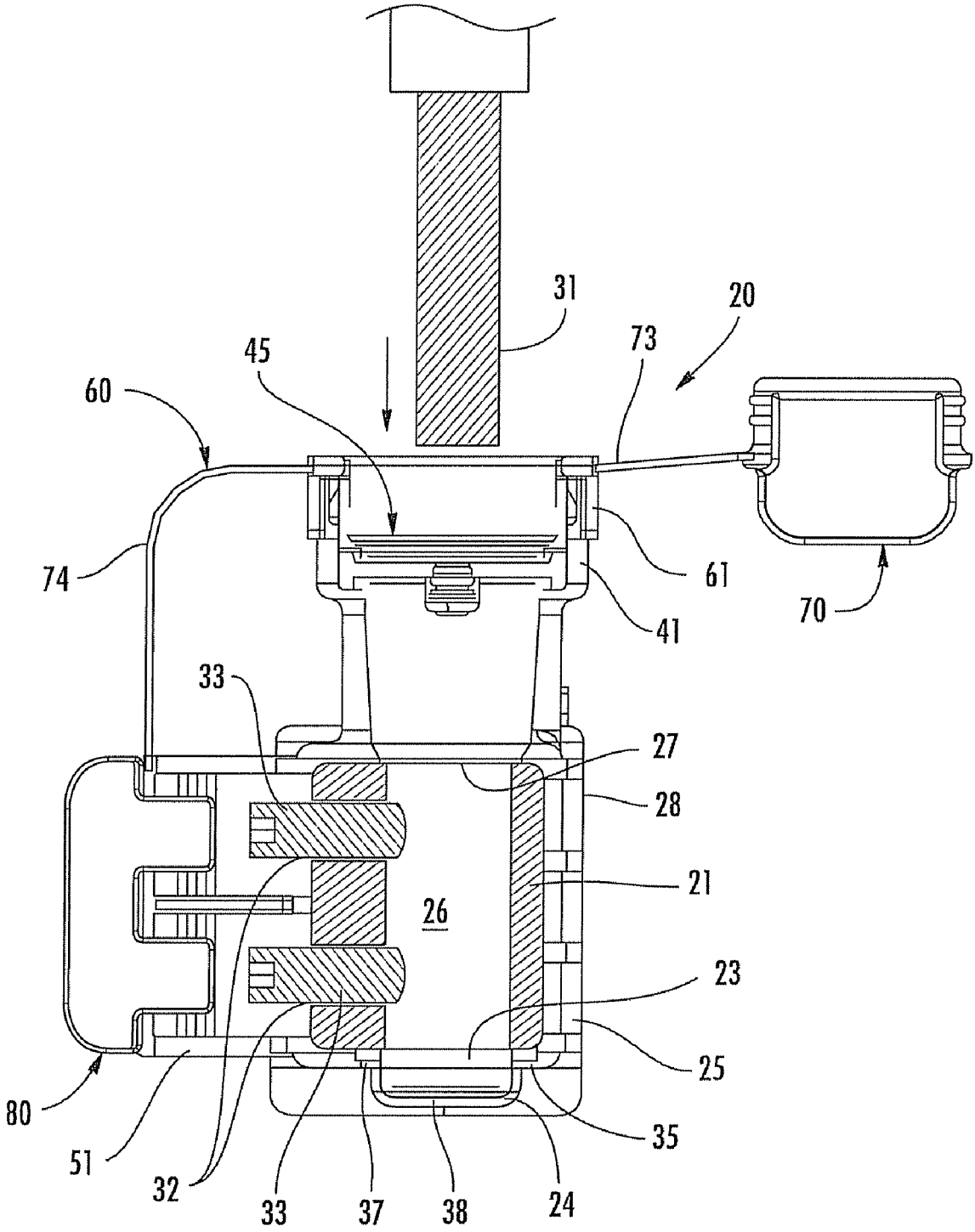
FIG. 6 is a cross-sectional view of the electrical connector shown in FIG. 1.
Figure 7:
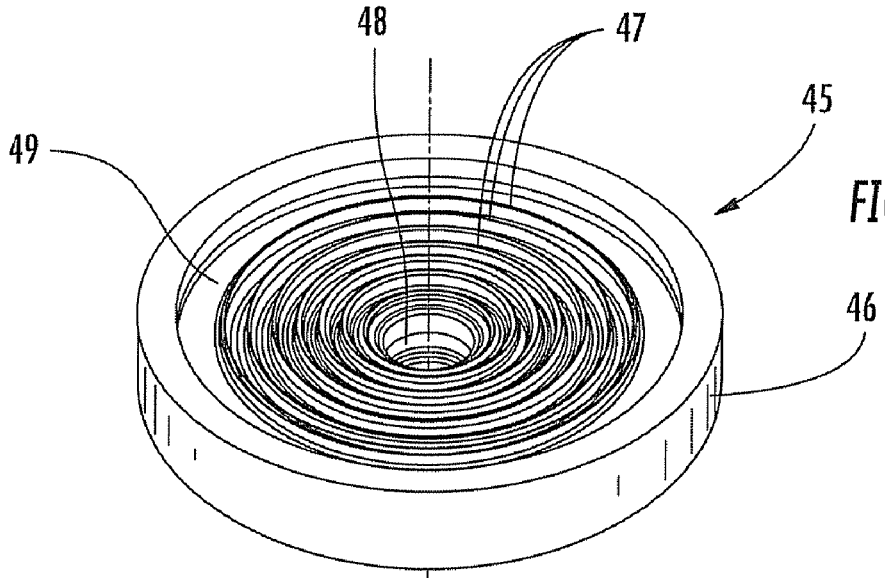
FIG. 7 is a top perspective view of the cable end seal of the electrical connector shown in FIG. 1.
Figure 8:
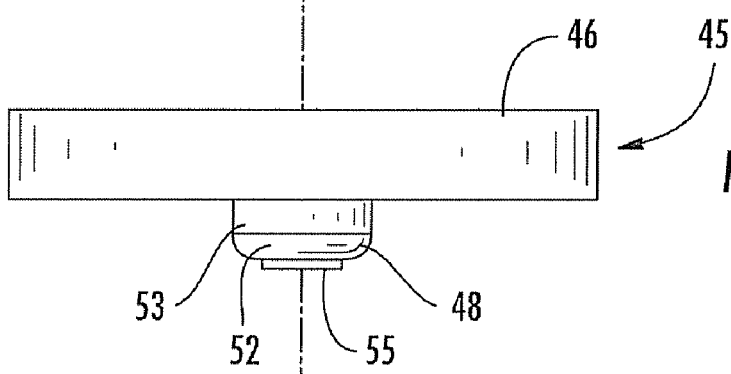
FIG. 8 is a side elevational view of the cable end seal shown in FIG. 7.
Figure 9:
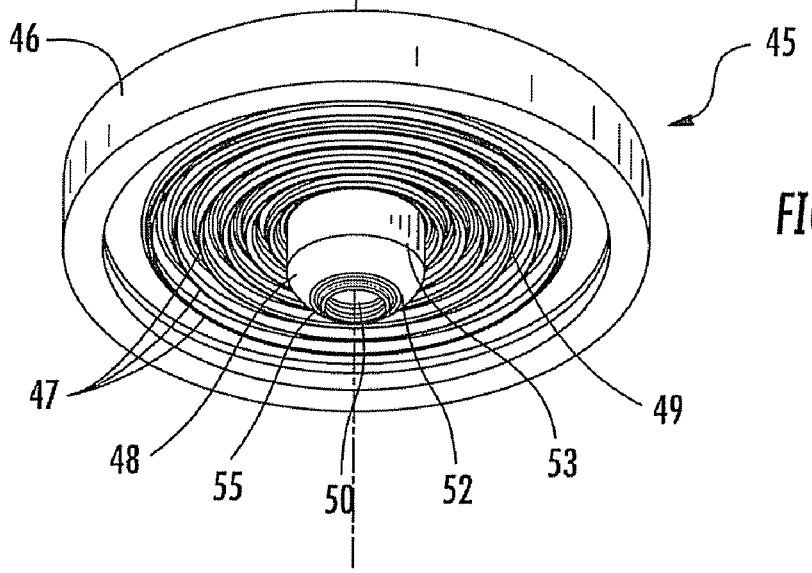
FIG. 9 is a bottom perspective view of the cable end seal shown in FIG. 7.
Figure 10:
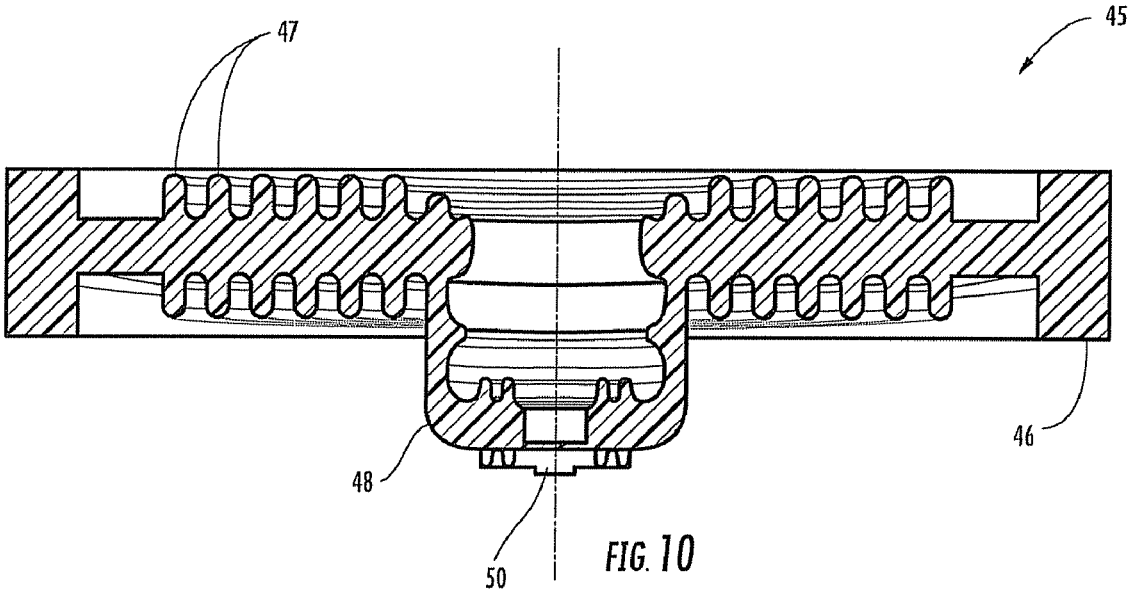
FIG. 10 is an enlarged cross-sectional view of the cable end seal shown in FIG. 7.

The electrically conductive body 21 also has a plurality of spaced apart cable-receiving passageways 26 each for receiving a respective insulation-free electrical cable end 31 therein (FIG. 6). In the illustrated embodiment of the electrical connector 20, five such passageways 26 are provided, however in other embodiments, more or less than five may be provided as will be appreciated by those skilled in the art. Of course, not all of the cable-receiving passageways need be used.

Each cable-receiving passageway 26 has a cable inlet opening 27 and the cable end viewing opening 23 opposite the cable inlet opening (FIG. 6). The electrically conductive body 21 also illustratively has a pair of respective fastener-receiving passageways 32 intersecting each cable-receiving passageway 26 (FIG. 6). A respective fastener 33 is also provided in each of the fastener-receiving passageways 32 (FIG. 6). Each of the fasteners 33 may be a hex head fastener with a rounded contacting end, for example. In addition, in other embodiments, only one fastener may be used for each cable end 31 as will be appreciated by those skilled in the art.

Each electrically insulating transparent viewing window 24 may be positioned adjacent a respective cable end viewing opening 23. The windows 24 thereby provide a cover and permit visual confirmation of proper placement of the insulation-free electrical cable end 31 within a corresponding one of the cable-receiving passageways 26. By transparent is meant that proper positioning of the cable end 31 is visible therethrough. Accordingly, although the window 24 can be fully transparent, transparent is also meant to include partially transparent or translucent where proper seating of the cable end is still viewable.

The insulating cover 25 on the electrically conductive body 21 also has respective window openings 35 therein aligned with the transparent viewing windows 24 (FIG. 6). The insulating cover 25 may preferably comprise TPE in some embodiments thereby forming an integrally molded bond with adjacent portions of the transparent viewing windows 24 as will be appreciated by those skilled in the art. In other embodiments, the cover 25 may comprise other plastic or rubber insulating materials. Each of the transparent viewing windows 24 may comprise a mounting flange 37 and a lens 38 extending outwardly therefrom. This configuration of the transparent viewing window 24 and through-holes, as contrasted with blind holes, permits the cable end 31 to extend further past the fasteners 33 to thereby result in a more secure connection as will be appreciated by those skilled in the art.

The mounting flange 37 may be overlapped by adjacent portions of the insulating cover 25. The mounting flange 37 and the lens 38 may be integrally formed as a monolithic unit, for example, such as by molding. Each transparent viewing window 24 may comprise polypropylene to form a strong bond with the TPE of the insulating cover 25. Other similar compatible materials may also be used that are moldable and that form a strong bond to the material of the insulating cover 25. The window 24 may serve to close or seal the cable-receiving passageway 26 during molding of the insulating cover 25. Of course, as will be appreciated by those skilled in the art, the windows 24 may not be needed in other embodiments.

The insulating cover 25 also illustratively includes an integrally molded respective cable inlet 41 aligned with each of the cable inlet openings 27. Each cable inlet 41 is tubular in shape in the illustrated embodiment, although other shapes are possible as well. The electrical connector 20 may further include a respective cable end seal 45 received in each of the cable inlets 41 as will be described in greater detail below. The insulating cover 25 also illustratively comprises an integrally molded respective dual-port fastener inlet 51 aligned with each of the fastener-receiving passageways 32 (FIG. 6). The fastener inlet 51 is also illustratively tubular but could have other shapes in other embodiments. In other embodiments a single-port fastener inlet could be provided for use with either a single fastener, or with multiple fasteners. The cover 25 also illustratively includes external ribs 28 that provide additional mechanical protection, facilitate gripping by an installer, provide flow channels during molding, and/or may provide enhanced heat dissipation for the connector 20.

Figure 3:
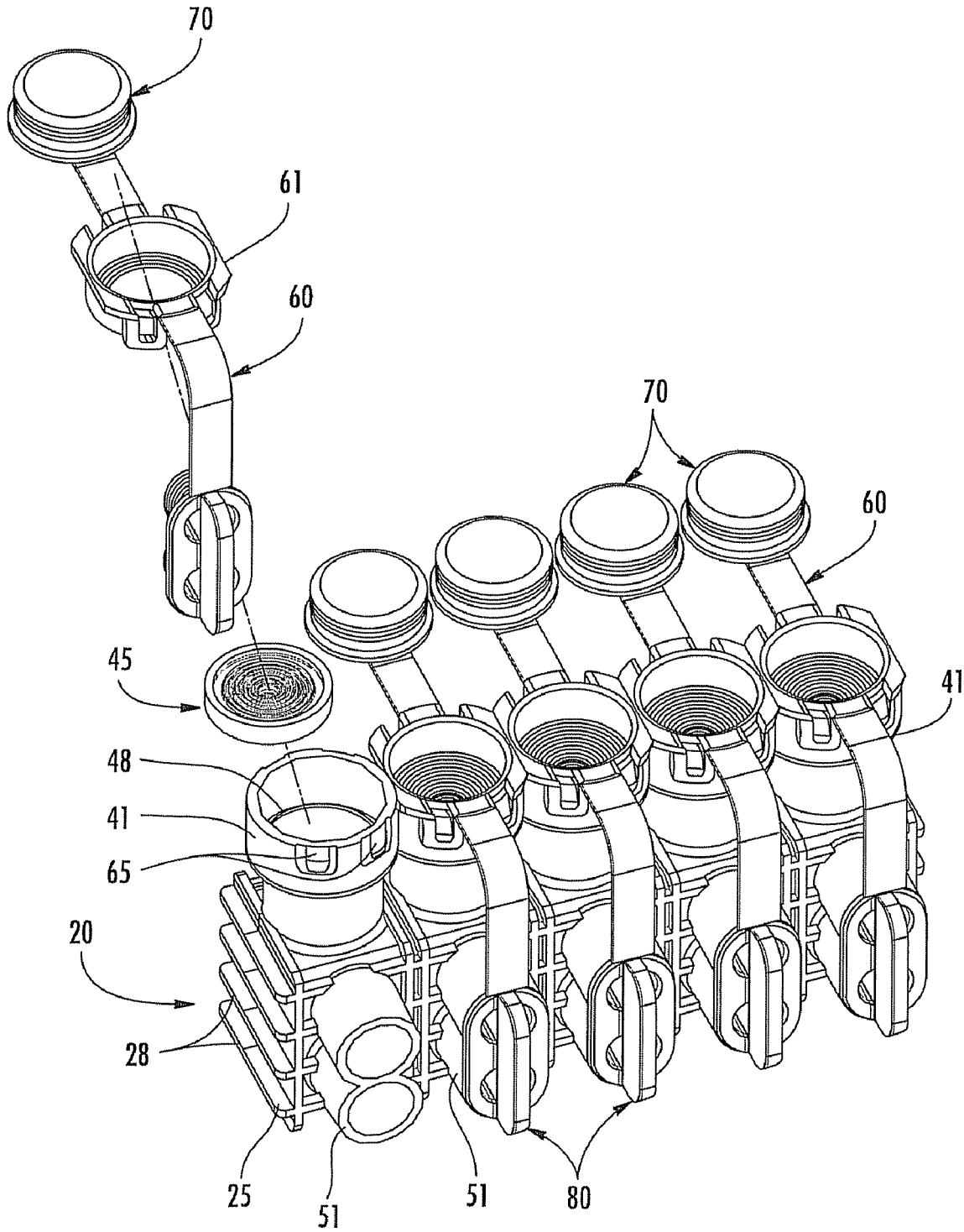
FIG. 3 is a front perspective partially exploded view of the electrical connector shown in FIG. 1.
Figure 4:
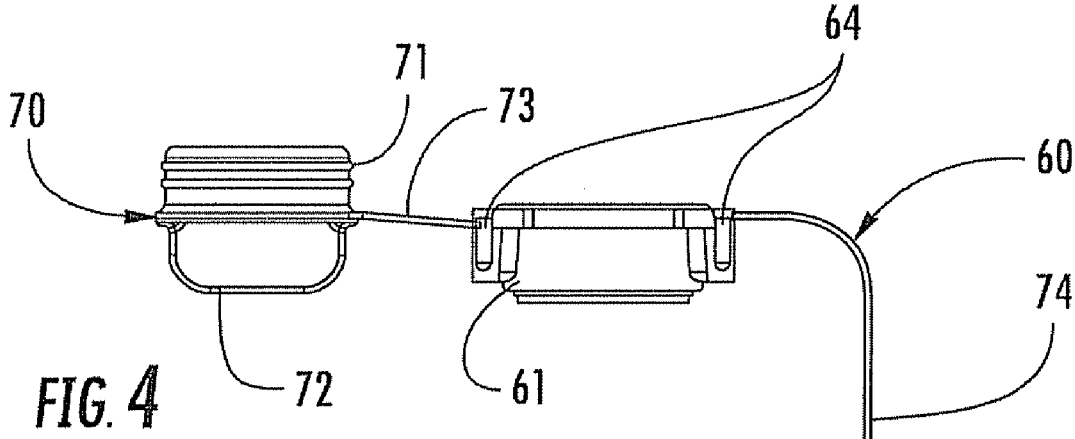
FIG. 4 is a side elevational view of the tether assembly of the electrical connector shown in FIG. 1.
Figure 5:
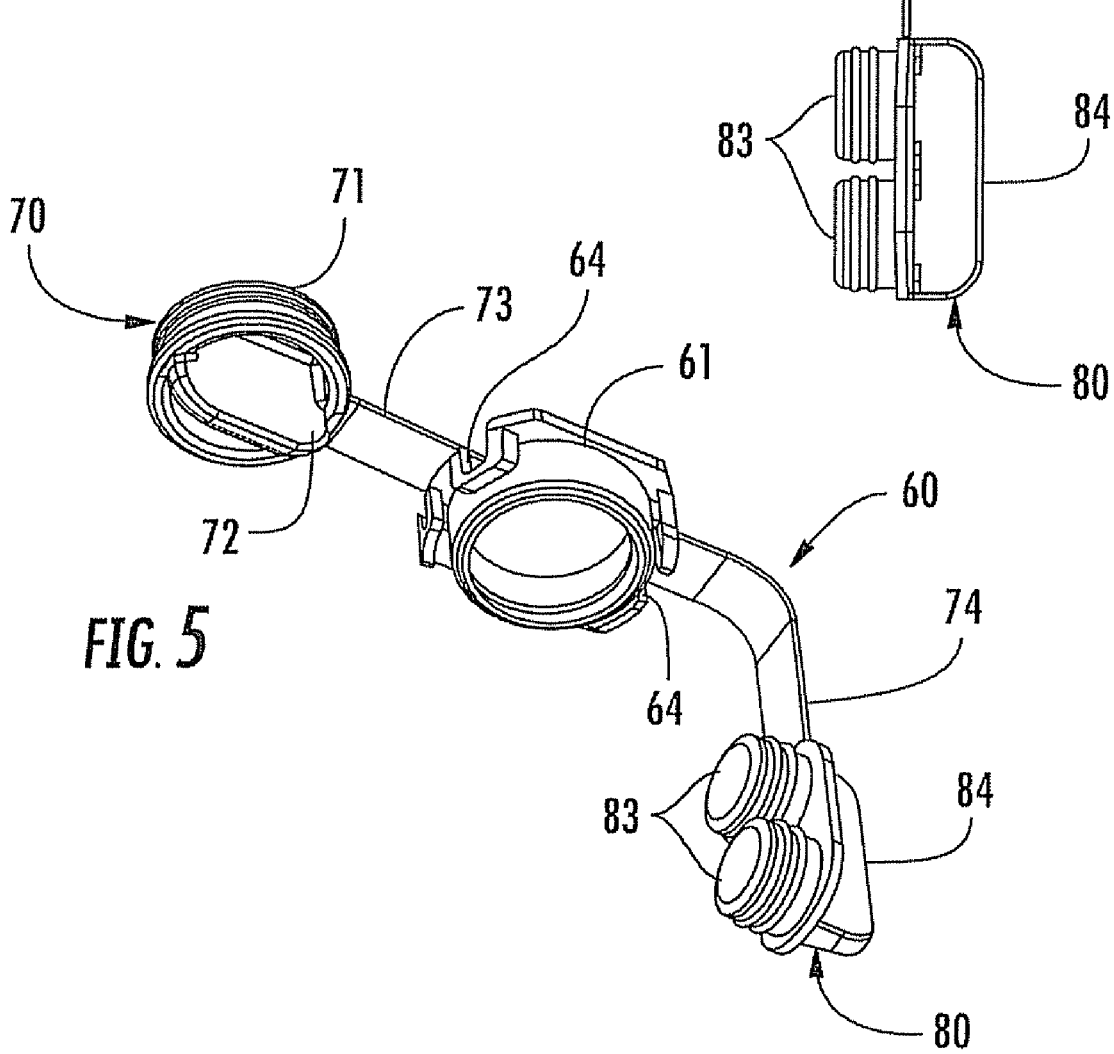
FIG. 5 is a bottom perspective view of the tether assembly shown in FIG. 4.

The electrical connector 20 also includes a plurality of plug tether assemblies 60, the components of which are perhaps best understood with specific reference to FIGS. 4 and 5. The plug tether assembly 60 illustratively includes a base ring 61 received in a snap-fitting engagement on the upper end portion of the cable-receiving inlet 41 (FIG. 3). The base ring 61 carries external locking loops 64 that cooperate with corresponding tabs 65 (FIG. 3) on the cable-receiving inlet 41 to provide the snap-fitting engagement as will be appreciated by those skilled in the art. In other words, the external locking loops 64 may be considered as providing first snap-fitting features, and the tabs 65 may be considered as providing second snap-fitting features. Of course in other embodiments, the base may have a different shape other than a ring-shape, and different mechanical and/or adhesive approaches may be used to secure the plug tether assembly 60 insulating cover 25 as will also be appreciated by those skilled in the art.

As perhaps best seen in the exploded view portion of FIG. 3, the base ring 61 is illustratively received within the upper end of the cable inlet 41 and serves to capture the cable end seal 45 in position against the internal shoulder 48 of the cable inlet 41. This arrangement also facilitates manufacturing and assembly of the connector 20 as will be appreciated by those skilled in the art.

The plug tether assembly 60 illustratively includes a cable inlet plug 70 joined to the base ring 61 via a first flexible tether strap 73. The cable inlet plug 70 illustratively includes a hollow closure cap 71 to be removably received in the cable inlet opening 27, and a gripping member 72 extending from within the closure cap to outside of the cap. The gripping member 72 may be grasped by the installer, either manually or using a suitable tool.

The plug tether assembly 60 also includes a fastener inlet plug 80 joined to the base ring 61 via a second flexible tether strap 74. The first flexible tether strap 73 and the second flexible tether strap 74 extend outwardly from opposite sides of the base ring 61. The inlet plug 80 illustratively includes two closure caps 83 and an associated gripping member 84. Of course in other embodiments, only a single closure cap 83 may be used. The fastener inlet plug 80 provides selective access to permit tightening of the fasteners 33 and thereafter provides an environmental seal.

As will be readily appreciated by those skilled in the art, the plug tether assembly 60 may be integrally molded as a unitary body from a suitable material, such as a TPE material or rubber material, for example. The plug tether assemblies 60 may also be made out of two or more grades of TPE, a single grade of TPE, or a TPE and polypropylene, for example. Of course, other suitable materials may also be used. Accordingly, while the plug tether assemblies 60 facilitate manufacturing, they also keep the plugs 70, 80 and other portions of the connector 20 together so they remain together even when the plugs are not being used or are temporarily removed for access.

Referring now additionally to FIGS. 7-11, features of the cable end seal 45 are further described. The seal 45 includes an annular tear stop member 49 and an outer ring-shaped body 46 surrounding the outer portion of the annular tear stop member. The annular tear stop member 49 illustratively includes a series of concentric annular ribs 47. The material of the seal 45 is desirably elastic to accommodate different sized wires and/or cables as will be appreciated by those skilled in the art. Depending on the size of the wire or cable end, the tear stop member 49 may be torn out to a concentric ring or rib 47 which then forms a tight seal to the adjacent cable end portions as will be appreciated by those skilled in the art.

Figure 11:
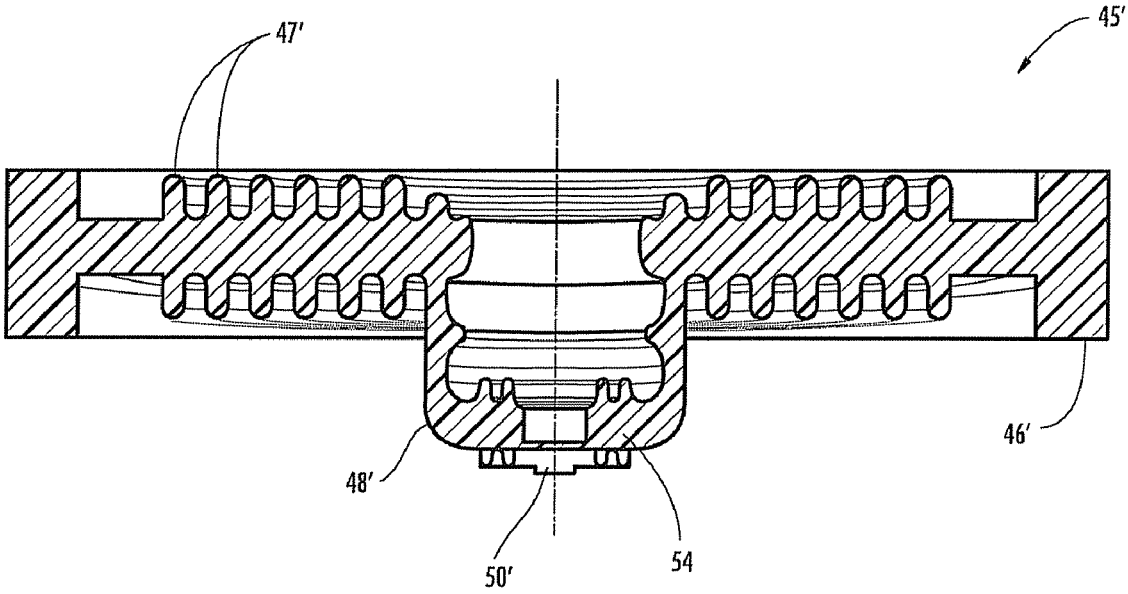
FIG. 11 is a cross-sectional view of another embodiment of the cable end as shown in FIG. 10.

A nipple 48 is illustratively coupled to the inner portion of annular tear stop member. The nipple 48 depends from the annular tear stop 49 into a respective cable inlet 41 as illustrated in FIG. 6, for example. The nipple 48 includes a central opening 50 therethrough in the illustrated embodiments of FIGS. 7-10. In the alternative embodiment of the seal 45' shown in FIG. 11, this opening 50' may be initially closed by a rupturable membrane 54 as will be appreciated by those skilled in the art. Those other elements shown in FIG. 11 are indicated with prime notation and are similar to those described above.

The nipple 48 also includes a tubular body portion 53 and end portion 52 coupled to the nipple. Illustratively, the nipple 48 includes a concentric rib 55 carried by the end portion 52. More than one concentric rib may be carried by the end portion 52.

The nipple 48 desirably guides and directs a relatively small gauge wire or cable therethrough and forms an environmental seal thereagainst. For larger cable ends, the nipple 48 may be torn away, or torn partly out of the way, and the cable end will seal against the respective adjacent annular rib 47. In other words, the properly sized rib 47 will serve as a tear stop and seal against the cable end as will be appreciated by those skilled in the art. This feature permits the concentric ring section to facilitate a range of wire or cable sizes without undue stress. In addition, the seal 45 and the tear stop member 49 may be integrally molded as one piece from a material, such as a silicone material, for example, that provides the desired degree of elasticity or resilience.

Figure 12:
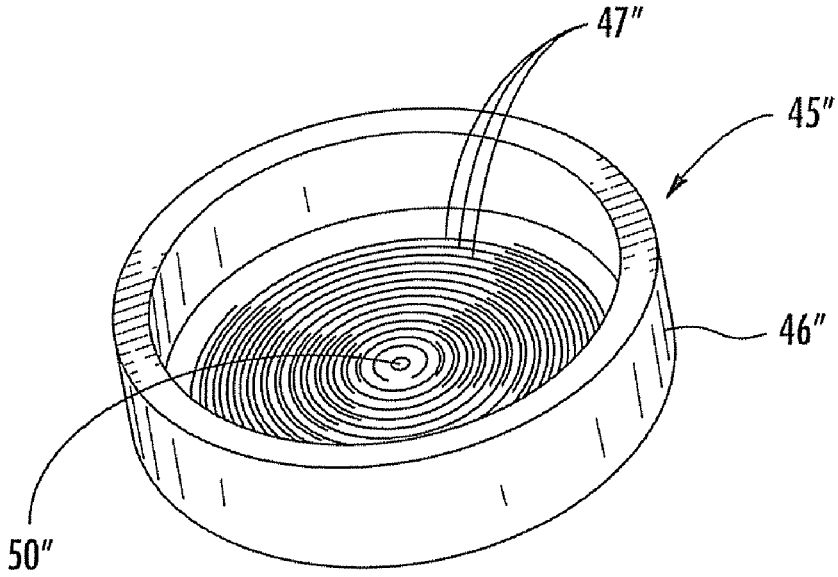
FIG. 12 is a perspective view of yet another embodiment of a cable end seal according to the present invention.
Figure 13:
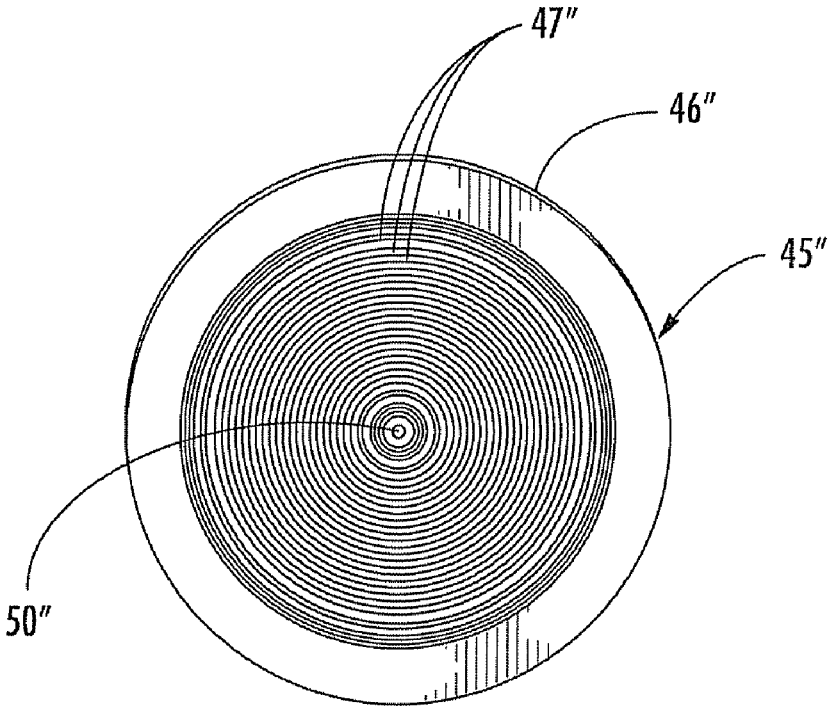
FIG. 13 is a top plan view of the cable end seal shown in FIG. 12.

Referring now additionally to FIGS. 12 and 13 yet another embodiment of a cable end seal 45" is now described. In this embodiment there is no nipple, but rather the concentric ribs or rings 47" of the tear stop 49" extend into the central area. The tear stop 49" is carried by the outer ring-shaped body 46". In the illustrated embodiment, the seal 45" has a central opening 50", but in other embodiments the opening may be initially closed by a rupturable membrane as will be appreciated by those skilled in the art.

A method aspect of the invention is directed to a method for making the electrical connector 20 including forming and attaching a plug tether assembly 60 to each cable inlet 41 as described above. Another method is directed to making the cable seal 45 described above and/or positioning it within the cable inlet 41 as also described above. Of course, other methods are also contemplated by the present invention based upon the connector described herein.

Figure 14:
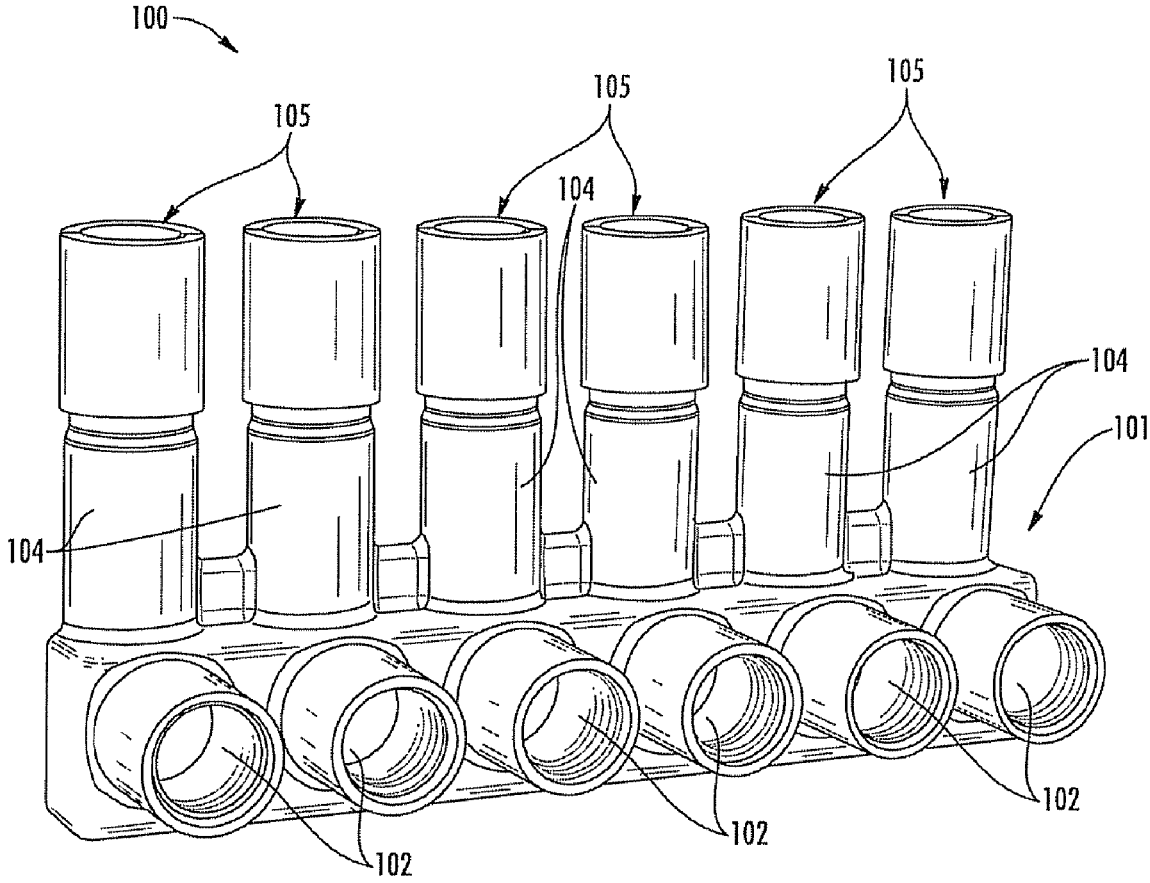
FIG. 14 is a front perspective view of an alternative embodiment of an electrical connector in accordance with the present invention.
Figure 15:
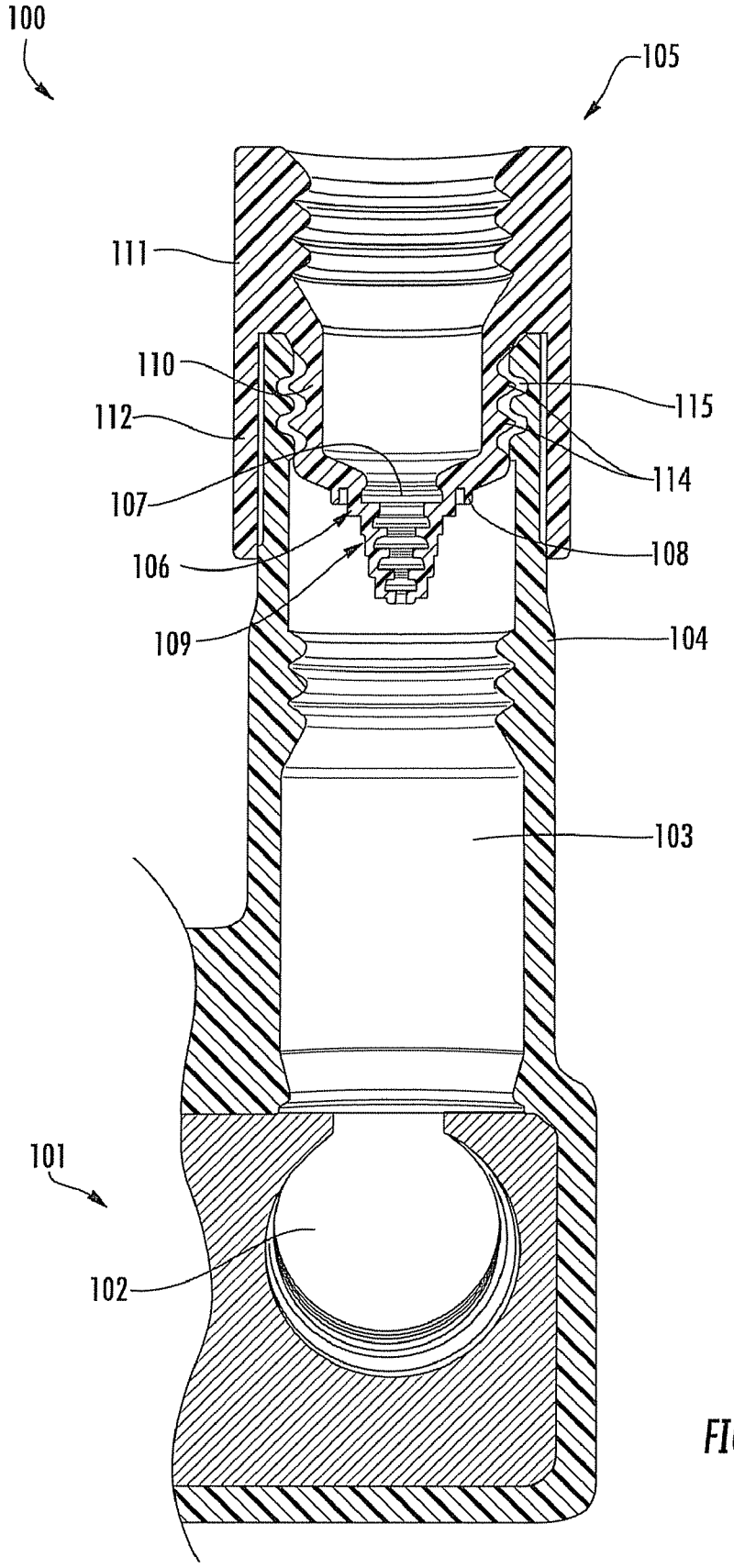
FIG. 15 is a cross-sectional view of the electrical connector shown in FIG. 14.
Figure 16:
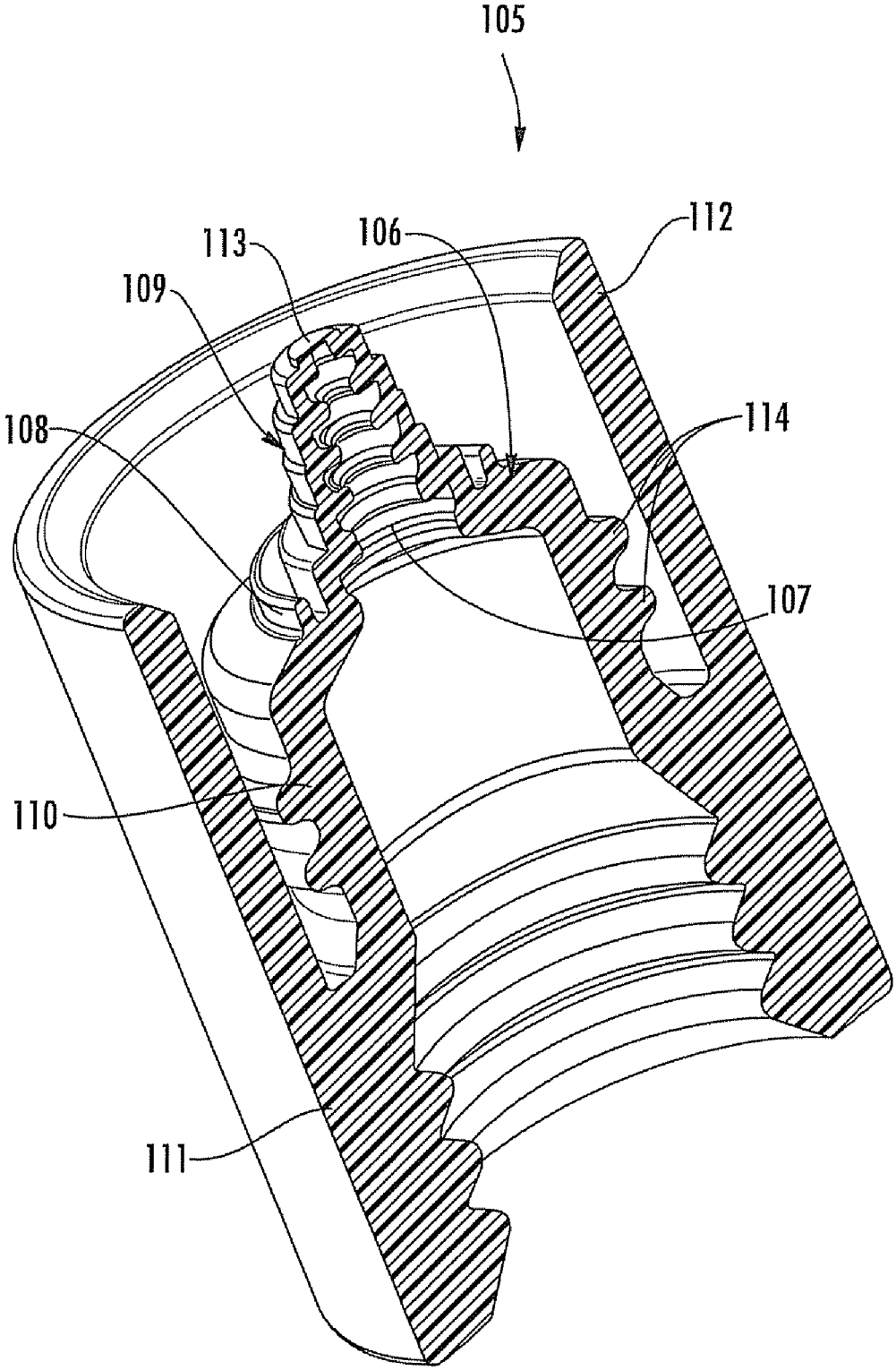
FIG. 16 is a perspective cutaway view of the cable end seal of FIG. 14.

With reference to FIGS. 14-16, a further embodiment of the electrical connector 100 of the present invention is now described. The electrical connector 100 is for a plurality of electrical cables and comprises an electrically conductive body 101 having a plurality of spaced apart cable-receiving passageways 103 (FIG. 15) for receiving respective electrical cable ends therein. Respective fastener-receiving passageways 102 intersect each of the cable-receiving passageways 103. A respective fastener (not shown) may be provided in each of the fastener-receiving passageways 102. Further details of suitable fasteners that may be used with the electrical connector 100 are described above with reference to the electrical connector 20 of FIG. 6. Those of skill in the art will appreciate that, rather than a single fastener-receiving passageways 102 intersecting the cable-receiving passageways 103, a plurality of single fastener-receiving passageways may intersect each cable-receiving passageway.

Figure 20:
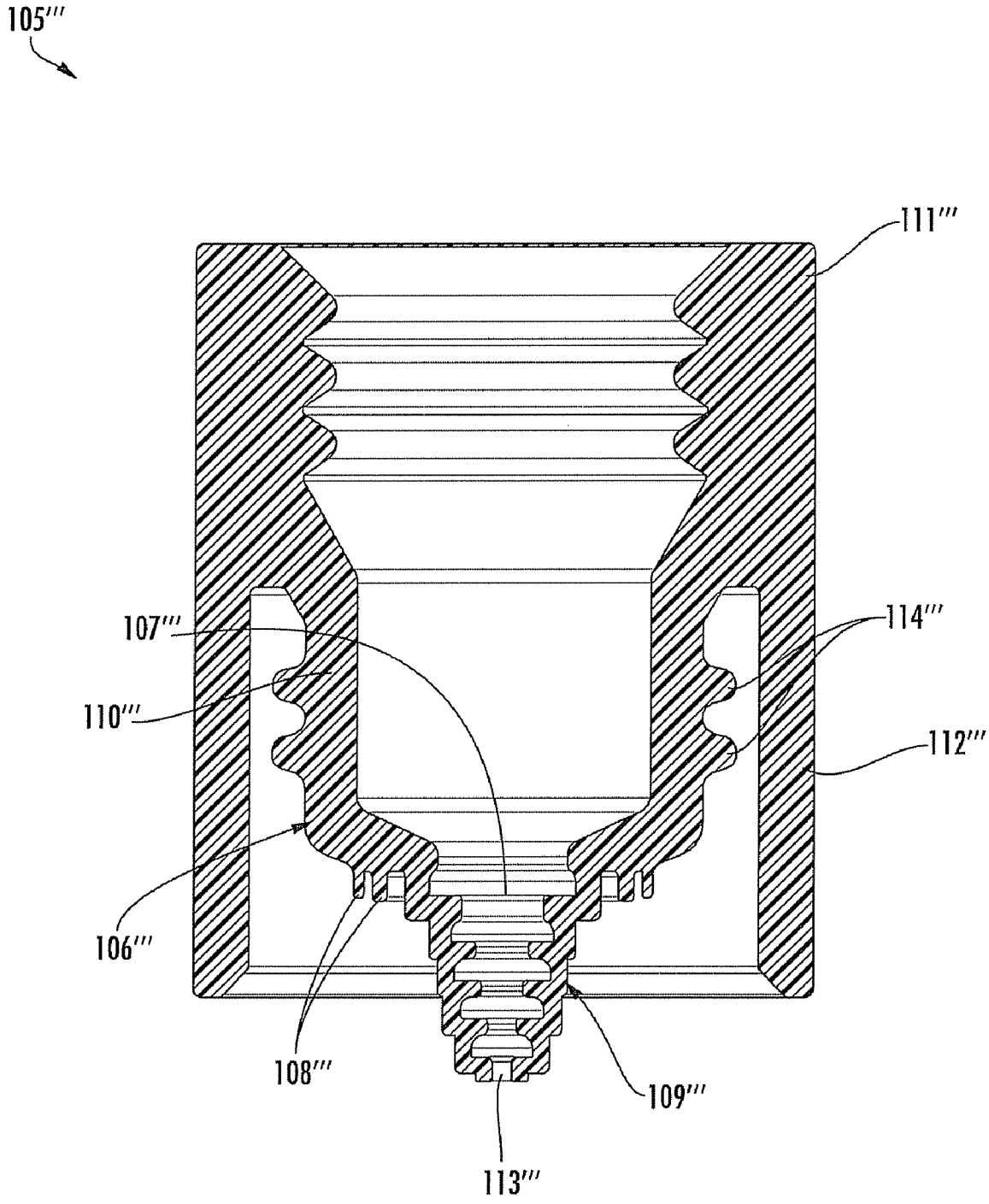
FIG. 20 is a cross-sectional view of an alternative embodiment of the cable end seal of FIG. 14 in accordance with the present invention.

An insulating cover 104 is on the electrically conductive body. The insulating cover 104 has a respective cable inlet aligned with each of the cable-receiving passageways 103. A respective cable end seal 105 is associated with each of the cable inlets and comprises a resilient, tearable body of material. The cable end seal 105 includes a first tear stop member 106 comprising a planar portion defining a central opening 107. At least one coaxial and coplanar rib 108 extends from the planar portion 106 is spaced from the central opening 17. As shown in FIG. 20, there may be a plurality of coaxial and coplanar ribs 108'''.

A second tear stop member 109 is illustratively coupled to the first tear stop member 106 at the central opening 107 and comprises a series of stepped tear stop portions having progressively decreasing diameters. The first and second tear stop members 106, 109 may have an annular shape. In addition, the coaxial and coplanar rib 108 may have an annular shape.

A tubular intermediate portion 110 is illustratively coupled to the first tear stop 106 member at a periphery thereof. A tubular base portion 111 is coupled to the tubular intermediate portion 110.

An outer tubular portion 112 is coupled to the tubular base portion 111 and surrounds in spaced relation the tubular intermediate portion 110 to receive a corresponding cable inlet 103 therebetween (as perhaps best shown in FIG. 15). A plurality of radially outer ribs 114 are coupled to the tubular intermediate portion 110. The ribs 114 fit into corresponding recesses 115 defined in the interior of the cable inlet 103 to securely locate and retain the cable end seal 105 on the cable inlet.

The second tear stop member 109 in the illustrated embodiment has a closed distal end 113. Of course, as shown in FIG. 20, the second tear stop member 198' may have an open distal end 113'.

A wall thickness of the first tear stop member 106 may be greater than a wall thickness of the second tear stop member 109. This is to facilitate an easier rupture of the second tear stop member 109 by smaller cable ends. The first and second tear stop members 106, 109 are preferably integrally molded as a monolithic unit in some embodiments.

The resilient, tearable body material of the cable end seal 105 is desirably elastic to accommodate different sized wires and/or cables, as will be appreciated by those skilled in the art. For example, the cable end seal 105 may have a percentage of elongation to yield of not less than about 300%. This may accommodate different cables sizes of from No. 14 up to 500 kcmil, for example, although other sizes are also possible.

The cable end seal 105 may comprise at least one of a silicone material, a thermoplastic elastomeric material, and a rubber material. Of course, the resilient tearable body material may be other suitable materials.

Depending on the size of the wire or cable end, the first tear stop member 106 and/or the second tear stop member 109 may be torn out to a stepped tear stop portion or rib 108, respectively, which then forms a tight seal to the adjacent cable end portions as will be appreciated by those skilled in the art.

Figure 17:
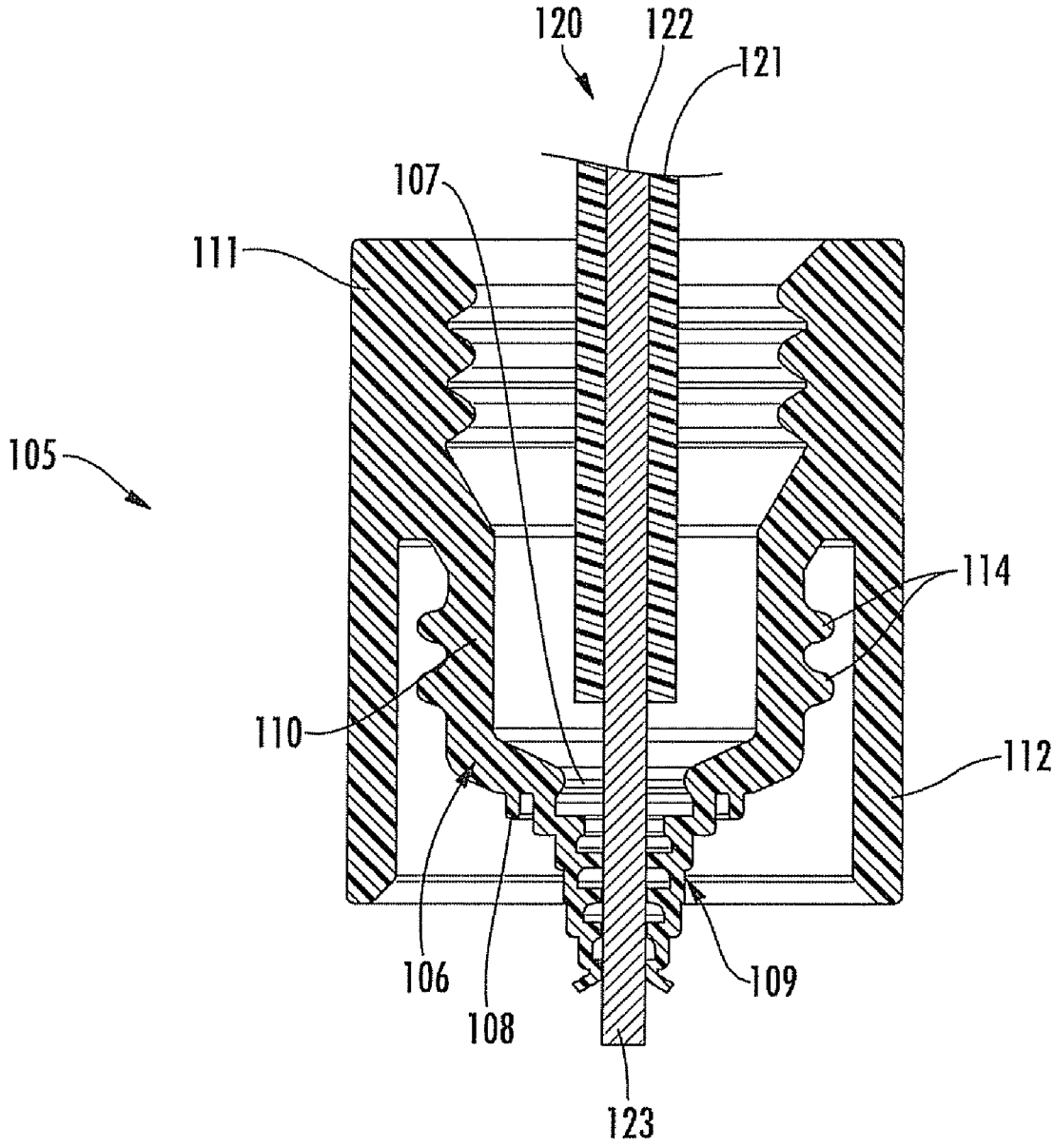
FIG. 17 is a cross-sectional view of the cable end seal of FIG. 14 with a small diameter cable inserted therethrough.
Figure 18:
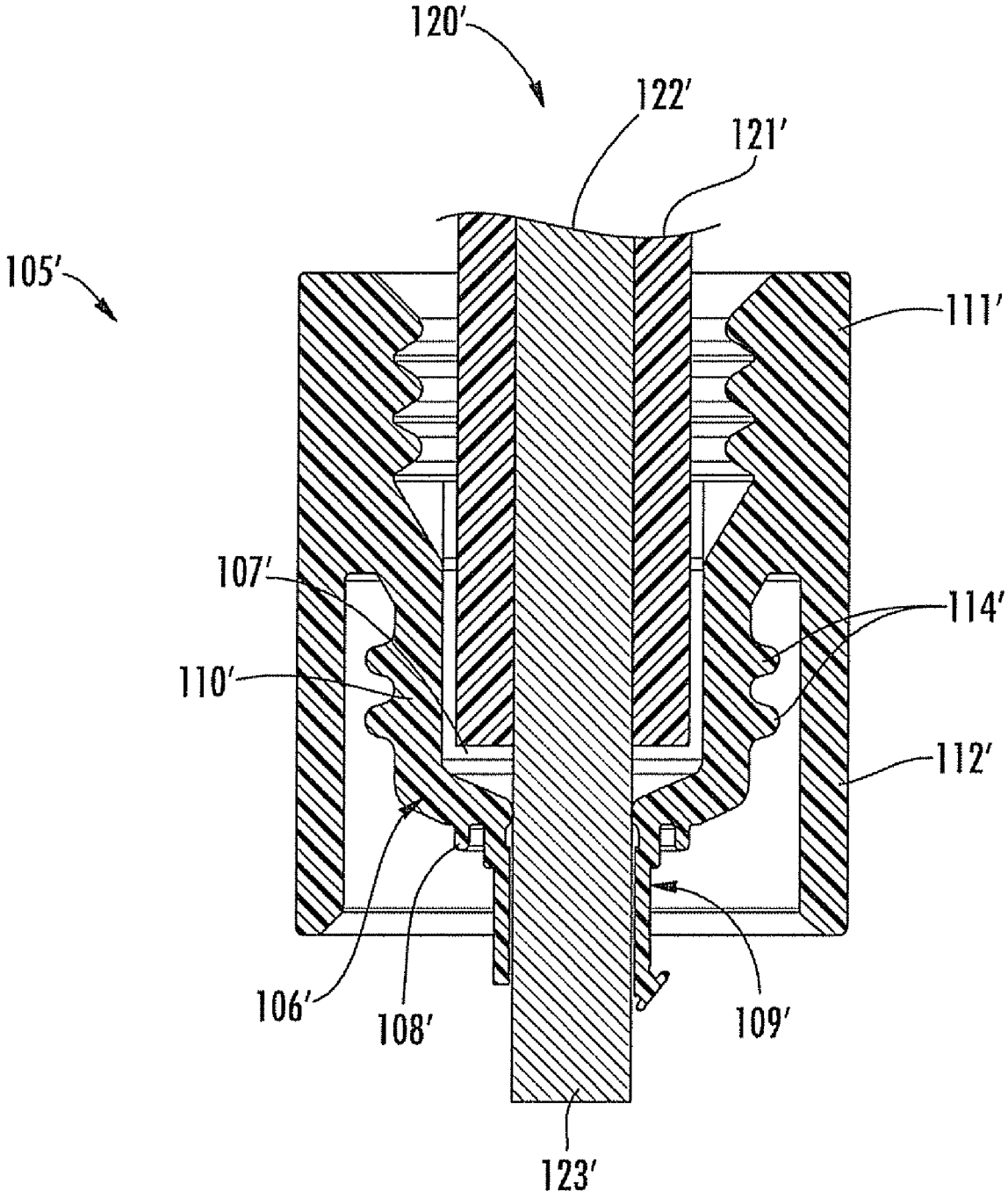
FIG. 18 is a cross-sectional view of the cable end seal of FIG. 14 with an intermediate diameter cable inserted therethrough.
Figure 19:
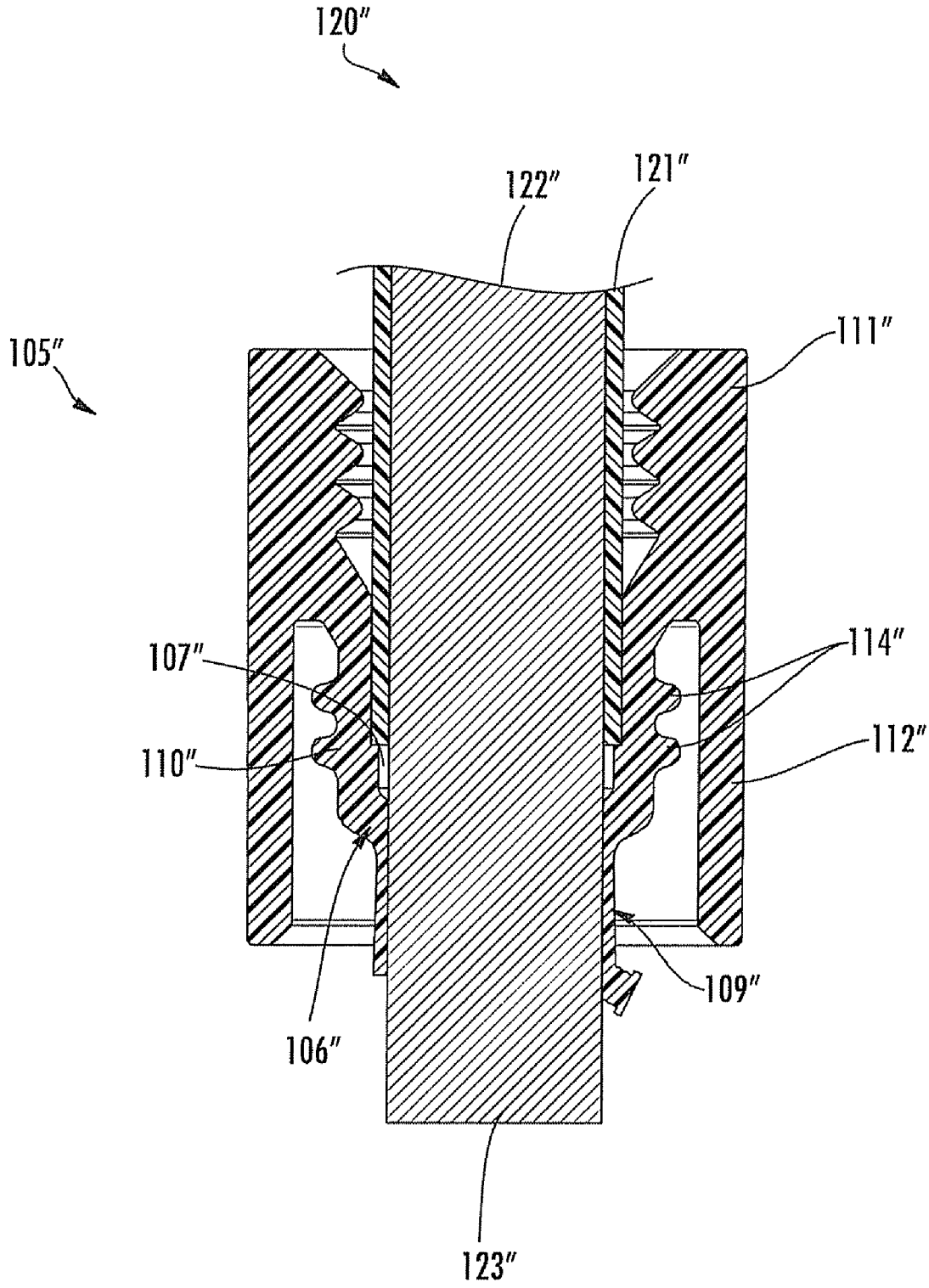
FIG. 19 is a cross-sectional view of the cable end seal of FIG. 14 with a large diameter cable inserted therethrough.

The second tear stop member 109 desirably guides and directs a relatively small gauge wire or cable therethrough and forms an environmental seal thereagainst (as shown in FIG. 17). For larger cable ends, the second tear stop member 109 may be torn away, or torn partly out of the way, and the cable end will seal against a respective adjacent rib 108 (as shown in FIGS. 18-19). In other words, the properly sized stepped tear stop portion or rib 108 will serve as a tear stop and seal against the cable end as will be appreciated by those skilled in the art. This feature permits the cable end seal 105 to effectively accommodate a range of wire or cable sizes.

Yet another aspect is directed to a method for making an electrical connector 100 for a plurality of electrical cables. The method may comprise forming an electrically conductive body 101 having a plurality of spaced apart cable-receiving passageways 103 for receiving respective electrical cable ends therein. The electrically conductive body 101 may have at least one respective fastener-receiving passageway 102 intersecting each of the cable-receiving passageways 103. The method further includes positioning an insulating cover 104 on the electrically conductive body 101 that has a respective cable inlet aligned with each of the cable-receiving passageways 103.

Moreover, the method includes forming a respective cable end seal 105 for being associated with each of the cable inlets 103. The cable end seal 105 includes a first tear stop member 106 comprising a planar portion defining a central opening 107 and at least one coaxial and coplanar rib 108 extending from the planar portion and spaced from the central opening. A second tear stop member 109 is coupled to the first annular tear stop member 106 at the central opening 107 and comprises a series of stepped tear stop portions having progressively decreasing diameters.

Other features and advantages in accordance with the invention may be understood with reference to copending application entitled: ELECTRICAL CONNECTOR WITH PLUG TETHER ASSEMBLY AND RELATED METHODS, 11/757,647, the entire contents of which is incorporated herein by reference, as well as in the above-mentioned U.S. Pat. Nos. 7,144,279 and 7,160,146, the entire contents of which are incorporated herein by reference. Indeed, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the invention.

That which is claimed is:

1. An electrical connector for a plurality of electrical cables comprising:

an electrically conductive body having a plurality of spaced apart cable-receiving passageways for receiving respective electrical cable ends therein, and having at least one respective fastener-receiving passageway intersecting each of the cable-receiving passageways;

an insulating cover on said electrically conductive body and having a respective cable inlet aligned with each of the cable-receiving passageways; and a respective cable end seal associated with each of the cable inlets and comprising a resilient, tearable body of material including a first tear stop member comprising a planar portion defining a central opening, and at least one coaxial and coplanar rib extending from said planar portion in an axial direction and spaced radially outwardly from the central opening, and a second tear stop member coupled to said first annular tear stop member at the central opening and comprising a series of stepped tear stop portions having progressively decreasing diameters.

2. The electrical connector according to claim 1 wherein said cable end seal further comprises a tubular intermediate portion coupled to said first tear stop member at a periphery thereof.

3. The electrical connector according to claim 2 wherein said cable end seal further comprises a tubular base portion coupled to said tubular intermediate portion.

4. The electrical connector according to claim 3 wherein said cable end seal further comprises an outer tubular portion coupled to said tubular base portion and surrounding in spaced relation said tubular intermediate portion to receive a corresponding cable inlet therebetween.

5. The electrical connector according to claim 1 wherein said second tear stop member has a closed distal end.

6. The electrical connector according to claim 1 wherein said second tear stop member has an open distal end.

7. The electrical connector according to claim 1 wherein said at least one coaxial and coplanar rib comprises a plurality of coaxial and coplanar ribs.

8. The electrical connector according to claim 1 wherein a wall thickness of said first tear stop member is greater than a wall thickness of said second tear stop member.

9. The electrical connector according to claim 1 wherein said first and second tear stop members are integrally molded as a monolithic unit.

10. The electrical connector according to claim 1 wherein said resilient, tearable body material comprises at least one of a silicone material, a thermoplastic elastomeric material, and a rubber material.

11. A cable end seal for an electrical connector comprising an electrically conductive body having a plurality of cable-receiving passageways and an insulating cover thereon, the insulating cover having a respective cable inlet aligned with each cable-receiving passageway, the cable end seal comprising:

a first tear stop member comprising a planar portion defining a central opening, and at least one coaxial and coplanar rib extending from said planar portion in an axial direction and spaced radially outwardly from the central opening; and a second tear stop member coupled to said first annular tear stop member at the central opening and comprising a series of stepped tear stop portions having progressively decreasing diameters.

12. The cable end seal according to claim 11 further comprising a tubular intermediate portion coupled to said first tear stop member at a periphery thereof.

13. The cable end seal according to claim 12 further comprising a tubular base portion coupled to said tubular intermediate portion.

14. The cable end seal according to claim 13 further comprising an outer tubular portion coupled to said tubular base portion and surrounding in spaced relation said tubular intermediate portion to receive a corresponding cable inlet therebetween.

15. The cable end seal according to claim 11 wherein said second tear stop member has a closed distal end.

16. The cable end seal according to claim 11 wherein said second tear stop member has an open distal end.

17. A method for making an electrical connector for a plurality of electrical cables comprising:

forming an electrically conductive body having a plurality of spaced apart cable-receiving passageways for receiving respective electrical cable ends therein, and having at least one respective fastener-receiving passageway intersecting each of the cable-receiving passageways;

positioning an insulating cover on the electrically conductive body and having a respective cable inlet aligned with each of the cable-receiving passageways; and forming a respective cable end seal for being associated with each of the cable inlets and comprising a first tear stop member comprising a planar portion defining a central opening, and at least one coaxial and coplanar rib extending from the planar portion in an axial direction and spaced radially outwardly from the central opening, and a second tear stop member coupled to the first annular tear stop member at the central opening and comprising a series of stepped tear stop portions having progressively decreasing diameters.

18. The method according to claim 17 wherein the cable end seal further comprises a tubular intermediate portion coupled to the first tear stop member at a periphery thereof.

19. The method according to claim 18 wherein the cable end seal further comprises a tubular base portion coupled to the tubular intermediate portion.

20. The method according to claim 19 wherein the cable end seal further comprises an outer tubular portion coupled to the tubular base portion and surrounding in spaced relation the tubular intermediate portion to receive a corresponding cable inlet therebetween.

21. The method according to claim 17 wherein the second tear stop member has a closed distal end.

22. The method according to claim 17 wherein the second tear stop member has an open distal end.

23. An electrical connector for a plurality of electrical cables comprising:

an electrically conductive body having a plurality of spaced apart cable-receiving passageways for receiving respective electrical cable ends therein, and having at least one respective fastener-receiving passageway intersecting each of the cable-receiving passageways;

an insulating cover on said electrically conductive body and having a respective cable inlet aligned with each of the cable-receiving passageways; and a respective cable end seal associated with each of the cable inlets and comprising a resilient, tearable body of material including a first tear stop member comprising a planar portion defining a central opening, and at least one coaxial and coplanar rib extending from said planar portion and spaced from the central opening, a second tear stop member coupled to said first annular tear stop member at the central opening and comprising a series of stepped tear stop portions having progressively decreasing diameters, a tubular intermediate portion coupled to said first tear stop member at a periphery thereof, and a tubular base portion coupled to said tubular intermediate portion, and an outer tubular portion coupled to said tubular base portion and surrounding in spaced relation said tubular intermediate portion to receive a corresponding cable inlet therebetween.

24. The electrical connector according to claim 23 wherein said second tear stop member has a closed distal end.

25. The electrical connector according to claim 23 wherein said second tear stop member has an open distal end.

26. The electrical connector according to claim 23 wherein said at least one coaxial and coplanar rib comprises a plurality of coaxial and coplanar ribs.

27. A cable end seal for an electrical connector comprising an electrically conductive body having a plurality of cable-receiving passageways and an insulating cover thereon, the insulating cover having a respective cable inlet aligned with each cable-receiving passageway, the cable end seal comprising:

a first tear stop member comprising a planar portion defining a central opening, and at least one coaxial and coplanar rib extending from said planar portion and spaced from the central opening;

a second tear stop member coupled to said first annular tear stop member at the central opening and comprising a series of stepped tear stop portions having progressively decreasing diameters;

a tubular intermediate portion coupled to said first tear stop member at a periphery thereof, and a tubular base portion coupled to said tubular intermediate portion; and an outer tubular portion coupled to said tubular base portion and surrounding in spaced relation said tubular intermediate portion to receive a corresponding cable inlet therebetween.

28. The electrical connector according to claim 27 wherein said second tear stop member has a closed distal end.

29. The electrical connector according to claim 27 wherein said second tear stop member has an open distal end.

30. The electrical connector according to claim 27 wherein said at least one coaxial and coplanar rib comprises a plurality of coaxial and coplanar ribs.

31. A method for making an electrical connector for a plurality of electrical cables comprising:

forming an electrically conductive body having a plurality of spaced apart cable-receiving passageways for receiving respective electrical cable ends therein, and having at least one respective fastener-receiving passageway intersecting each of the cable-receiving passageways;

positioning an insulating cover on the electrically conductive body and having a respective cable inlet aligned with each of the cable-receiving passageways; and forming a respective cable end seal for being associated with each of the cable inlets and comprising a first tear stop member comprising a planar portion defining a central opening, and at least one coaxial and coplanar rib extending from the planar portion and spaced from the central opening, a second tear stop member coupled to the first annular tear stop member at the central opening and comprising a series of stepped tear stop portions having progressively decreasing diameters, the cable end seal further comprising a tubular intermediate portion coupled to the first tear stop member at a periphery thereof, and a tubular base portion coupled to the tubular intermediate portion, and an outer tubular portion coupled to the tubular base portion and surrounding in spaced relation the tubular intermediate portion to receive a corresponding cable inlet therebetween.

32. The method according to claim 31 wherein the second tear stop member has a closed distal end.

33. The method according to claim 31 wherein the second tear stop member has an open distal end.

* * * * *